United States Patent [19]

Morton

[11] 3,984,932

[45] Oct. 12, 1976

[54] SNAP-IN AND SNAP-OUT SHELL CATCHER

[76] Inventor: Thomas B. Morton, 226 E. Valley Road, Knoxville, Md. 21758

[22] Filed: June 4, 1975

[21] Appl. No.: 583,842

[52] U.S. Cl. ..... 42/1 T
[51] Int. Cl.[2] ..... F41C 27/00
[58] Field of Search ..... 42/1 T

[56] References Cited

UNITED STATES PATENTS

| | | | |
|---|---|---|---|
| 3,087,387 | 4/1963 | Browning | 42/1 T |
| 3,603,015 | 9/1971 | Jensen | 42/1 T |
| 3,733,728 | 5/1973 | Kuslich | 42/1 T |
| 3,807,075 | 4/1974 | Mylonas | 42/1 T |
| 3,881,268 | 5/1975 | Petersen | 42/1 T |

*Primary Examiner*—Charles T. Jordan
*Attorney, Agent, or Firm*—Walter G. Finch

[57] ABSTRACT

A snap-in and snap-out shell catcher is provided for use on multiple shot semi-automatic guns. It has a shell ejection port mechanism which consists of a fixed plate and a movable plate (arm), a latch and spring arrangement, and a spring-wire hoop and loop, all of which are formed into one unit. The mechanism is readily attached to the side of the receiver of a gun.

The arm is attached to the fixed plate in such a manner that it can pivot around a single point near the center of the arm. The extent and timing of this pivoting action of this arm is limited and controlled by the latch and spring arrangement in conjunction with the normal firing and subsequent operation of the action of the gun on which it is fitted.

The spring-wire hoop and loop is attached to the forward muzzle end of the arm in such a manner that when the forward end of the arm is pivoted upwardly, the spring-wire hoop and loop will be positioned over the shell ejection port of the gun. The bolt of the gun can be either opened or closed, and the shell catcher will still not interfere with loading unfired shells into the chamber and/or the magazine of the gun. With the catcher in this position, it is ready to catch and hold the body of an ejected shell after the gun has been fired for easy removal by hand.

10 Claims, 4 Drawing Figures

FIG. 3

SNAP-IN AND SNAP-OUT SHELL CATCHER

BACKGROUND OF THE INVENTION

This invention relates generally to firearms apparatus, and particularly it pertains to a device for use in preventing a singly fired shell, or the second shell of each pair when shooting doubles, from being completely ejected from a semi-automatic gun. The device permits manual removal of the expended shell from the receiver of the gun, and it also permits reloading of the gun without removal of the catcher from the receiver of the gun.

Many trap, skeet, and other target shooting facilities have rules prohibiting shooters from retrieving shells fired from a gun from the ground. A large number of target shooters desire to retain their empty shells for subsequent reloading and reuse. However, a high percentage of these shooters employ semi-automatic guns, which eject all fired shells onto the ground.

Although these empty shells may sometimes be purchased from the shooting facility for a fee, they are in short supply, many of those actually so purchased are encrusted with dirt and grime, may require extensive cleaning and reconditioning before reuse, or may be damaged beyond repair. For these reasons, and a few others, such as speeding up the shooting procedure, safety, loss of expended shells in the grass or snow, the inconvenience of having to bend down to pick-up the empty shells, a device, such as the present invention has many desirable advantages.

Other shell catchers or restrainers presently available have certain disadvantages. The conventional fork-type and keeper rod type shell catchers are designed to attach to the bolt of the gun, and extend along the side of the receiver of the gun beside and in a spaced relationship to the ejection port opening. Catchers of this conventional type move rapidly and deliberately with the movement of the bolt, and in use are potentially dangerous to the hand of the shooter which holds the forward end of the gun on firing, or the hand of the shooter which holds the stock on recoil. In addition, both catchers must be removed prior to firing doubles, which means that all shells fired from the gun are then ejected onto the ground.

Another type shell catcher presently in use is the wire or spring-wire type, which can be installed on a semi-automatic gun by drilling two holes into the receiver at the top of the ejection port, and inserting a short length of suitably shaped stiff wire into the drilled holes. This catcher usually requires a gunsmith or other skilled persons to drill the holes and to fit a spring wire to the gun, which is easy to remove from the gun, but is often difficult to reinstall, and will not permit the firing of doubles when installed.

Still another type catcher consists of a suitable shaped wire which partially encircles the receiver of the gun as installed. This catcher has the possible disadvantage of shooter distraction or interference with the line of sight or sighting picture of the gun, inability to reliably remain in an operative position on the gun, potential damage to the receiver of the gun, and must be removed before doubles can be fired.

Another type also may require gun modification and may interfere with the line of sight or sighting picture of the gun during use, and also must be removed before doubles can be fired. Another shell catcher presently available overcomes many of the previously cited disadvantages of other shell catchers, but it is potentially dangerous in that a sharp lip on its lower extremity protrudes into the opening where shells are placed in the magazine, in close proximity to the carrier release or action release mechanism, where the fingers of the shooter may be cut when closing the action as is necessary each time the gun is readied for firing, and, it too, like all the other catchers described herein, must be removed from the gun before firing doubles.

In order for the skeet shooter to employ any of the shell catchers so far described, he must alternatively install the catcher to shoot singles, then remove it when shooting doubles. This procedure is distracting, cumbersome, and requires fumbling in pockets for the catcher prior to its installation for firing singles.

SUMMARY OF THE INVENTION

It is an object of this invention to provide a snap-in and snap-out type shell catcher for a semi-automatic gun which is easily installed, removed, and reinstalled by unskilled persons.

Still another object of this invention is to provide a snap-in and snap-out type shell catcher which retains all singly fired shells in semi-automatic guns from being completely ejected so as to facilitate recovery of the expended shell for reuse.

Yet another object of this invention is to provide a snap-in and snap-out type shell catcher which retains the second fired shell of each pair fired in doubles, in the same manner as for singly fired shells explained above.

Still another object of this invention is to provide a snap-in and snap-out type shell catcher which permits the catching of singly fired shells, or the second fired shell of each pair fired in doubles, without having to remove the catcher from the receiver of the gun to which it has been fitted.

The snap-in and snap-out catcher comprises a fixed plate onto which one or two pins are attached which replace the original front and/or rear trigger plate pins and which snap-in to the corresponding trigger plate holes in the receiver of a semi-automatic gun. This provides a means whereby the shell catcher may be attached to the receiver of the gun by any unskilled person without modifying the gun, and without special tools. Also attached to this fixed plate, is a latch which is held in place by a screw and spring assembly, and a movable plate (arm) which is fitted with a spring-wire hoop and loop and which is attached to the fixed plate by a spring loaded screw or rivet located near the center of the arm.

BRIEF DESCRIPTION OF THE DRAWINGS

Other objects and attendant advantages of this invention will become more readily apparent and understood from the following detailed specification and accompanying drawings in which.

DETAILED DESCRIPTION OF THE INVENTION

Figure 1:
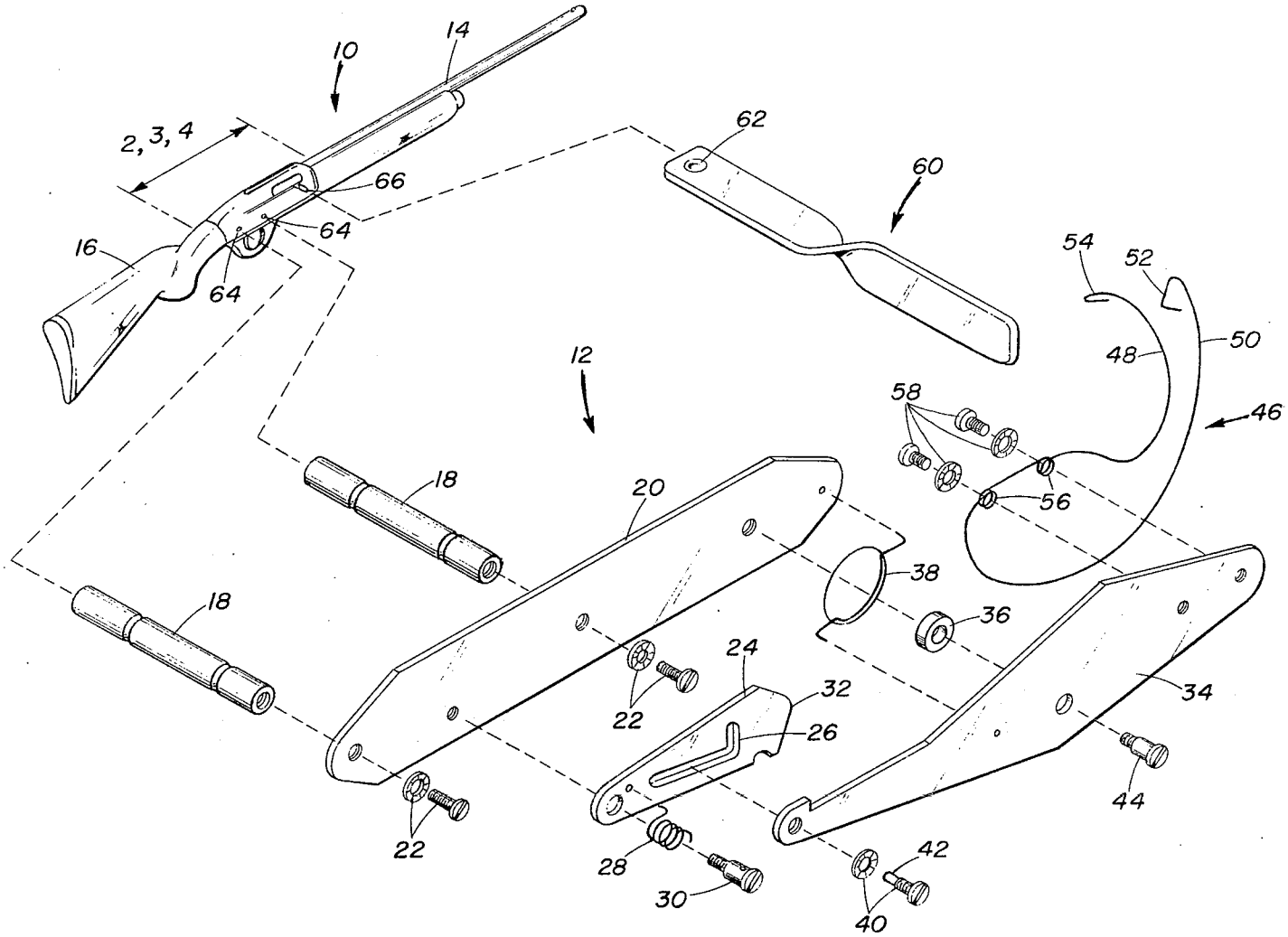
FIG. 1 is an exploded view of a snap-in shell catcher incorporating features of this invention for use with a multiple shot semi-automatic gun.

Referring now to FIGS. 1, 2, 3, and 4 of the drawings, there is shown a multiple shot semi-automatic gun 10 having a snap-in and snap-out shell catcher 12 mounted thereto. The gun 10 is provided with a barrel 14 and a gun stock 16. In addition, it is provided, with an operating handle 66, a chamber 70, a chamber cover 72 for the chamber 70, and a pair of mounting pins 64 for the trigger plates. The gun 10 is also provided with a slot 74, extending lengthwise thereof, for the operating handle 66, and a trigger 76.

The catcher 12 consists of a fixed plate 20 onto which is attached two mounting pins 18, each secured thereto by a lockwasher and screw 22. These two pins 18 replace the original front and/or rear trigger plate pins 64 and which snap-in to the corresponding trigger plate holes in the receiver of the gun 10. The purpose of this is to provide a ready means whereby the shell catcher 12 can be attached to the receiver of the gun 10 by any unskilled person without modifying the gun 10, and without the use of special tools.

A latch or locking arm 24 is attached to the fixed plate 20 by means of a screw and a spring assembly 28, 30. This latch or locking arm 24 is provided with a L-shaped slot 26. This latch 24 is provided with a trigger edge 32.

A movable plate or arm 34 is attached to the fixed plate 20 by a spring loaded screw 44 having a spacer 36 and a spring 38 near the center of the arm 34. A lockwasher and screw 40 having a pin 42 on one end is passed through the movable plate 34 at one end, and it is arranged to move in the slot 26 in the latch or locking arm 24.

A spring wire catcher 46 is secured by securing loops 56 to the opposite end of the movable plate 34 by means of a pair of lockwashers and screws 58. This spring wire catcher 46 included wire section 48 and wire section 50 having loop ends 54 and 52, respectively. An operating handle 60 having a dimple 62 is used for operating the shell catcher 12 and it is used to replace the operating handle 66.

The movable arm 34 is attached to the fixed plate 20 in such a manner that it can pivot around a single point at pin 44 near the center of the arm. The extent and timing of this pivoting action of arm 34 is limited and controlled by the latch 24 and spring arrangement 38 in conjunction with the normal firing of the gun and subsequent operation of the action of the gun 10 on which it is fitted.

The spring-wire hoop and loop 56, 46 is attached to the forward muzzle end of the movable arm, in such a manner that when the forward end of the arm 34 is pivoted upwardly, the spring-wire hoop and loop 56, 46 will be positioned over the shell ejection port of the gun 10.

The bolt of the gun 10 can be either opened or closed, and the shell catcher 12 will still not interfere with loading unfired shells 68 into the chamber 70 and/or the magazine. With the catcher 12 in this position, it is ready to catch and hold the body of an ejected shell 68, after the gun 10 has been fired, for easy removal by hand.

Figure 2:
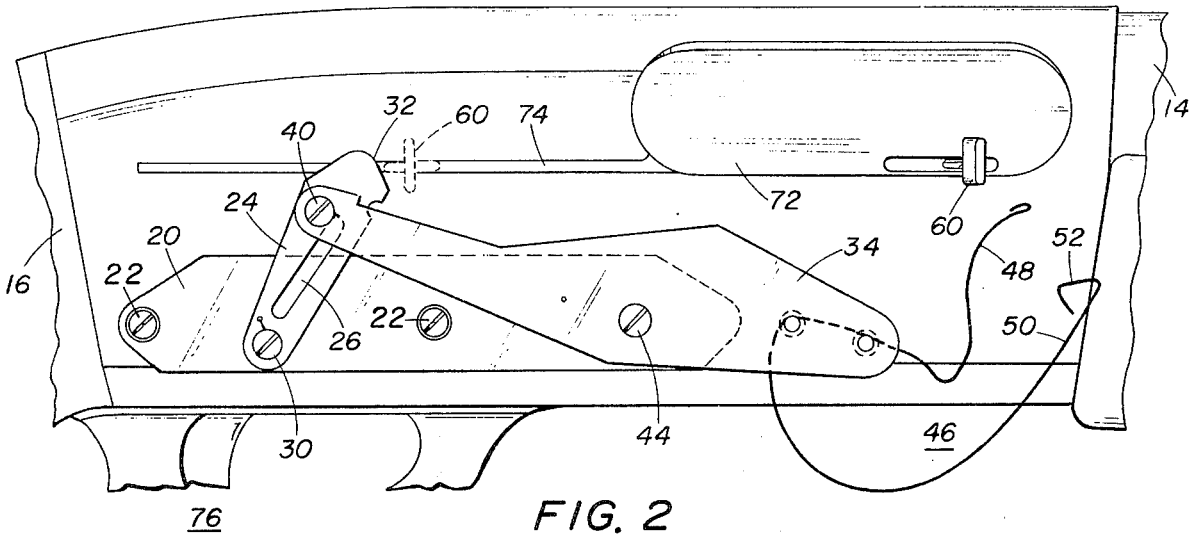
FIG. 2 is a partial side view of a multiple shot semi-automatic gun showing the shell catcher of FIG. 1 locked in its "down" position.

When a shooter desires to shoot doubles, one unfired shell is placed in the chamber, the bolt is closed, and the second unfired shell is inserted in the magazine. The shooter then positions the forward (hoop and loop) end of the arm 34 downward as shown in FIG. 2, by pivoting the rearward end of the arm plate upward and engaging it in the spring loaded latch assembly 24 as shown in FIG. 2.

When the first shell 68 is fired, it is extracted from the chamber 70, and ejected out of the gun 10 by normal action of the bolt and ejector. Since the spring-wire hoop and loop 56, 46 are below the level of the shell ejection port of the gun 10, the expended shell 68 is thrown clear of the gun and shell catcher and the expended shell 68 falls to the ground.

Figure 4:
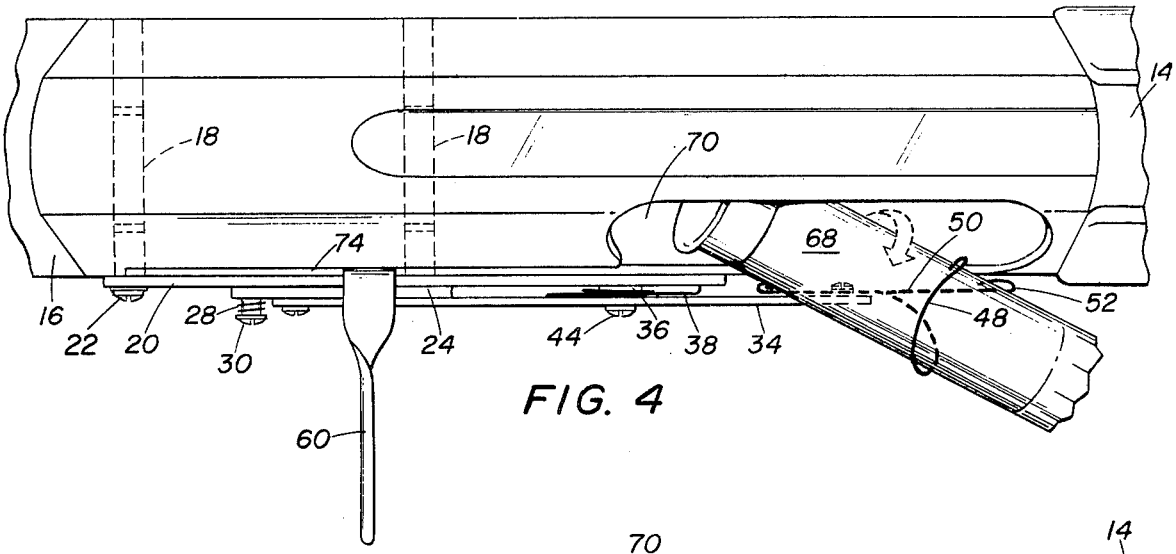
FIG. 4 is a top view of FIG. 3 showing the shell catcher of FIG. 1 in its "up" position, holding an ejected shell.
Figure 3:
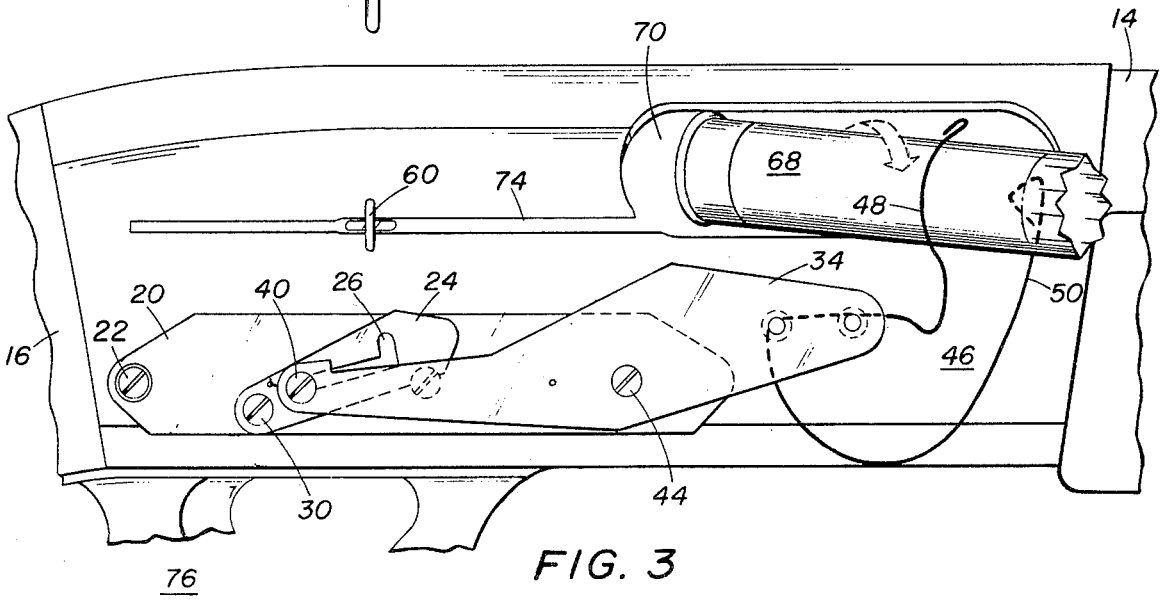
FIG. 3 is a partial side view of a multiple shot semi-automatic gun showing the shell catcher of FIG. 1 in its "up" position, holding an ejected shell.

The bolt assembly continues its rearward movement fully to the rear of the breech, in the normal manner, where the operating handle 60 trips the latch 24 which allows the main spring of the shell catcher 46 to pivot the forward end of the arm upwardly as shown in FIGS. 3 and 4, where the spring-wire hoop and loop 56, 46 covers the shell ejection port of the gun 10. The bolt then moves forward into battery, chambering the unfired shell 68 from the magazine, thereby readying the gun 10 for the second shot. Upon firing of the second shell, the bolt assembly moves to the rear, extracting the fired shell 68 from the chamber in the normal manner. However, the spring wire hoop and loop 56, 46 prevents its complete ejection from the gun 10, by holding the shell body partially projecting from the ejection port, thereby facilitating easy removal by hand.

Briefly, this shell catcher can be installed on a gun 10 by any unskilled person, with no special tools, without modifying the gun on which it is to be installed. In addition, it does not interfere with loading unfired shells into the chamber or magazine of the gun 10. It also permits catching of all shells fired singly, and half those fired in pairs (doubles). It does not need to be removed from the gun 10 between firing of either singles or doubles. When it is desired, moreover, to return the gun 10 to its original condition, for hunting, sale, or whatever, it can be easily removed without further modification to the gun. The shell catcher can be reinstalled for subsequent use on the same or another gun.

The shell catcher 12 of this invention is formed of aluminum with steel screws, lock washers, springs, and pins. However, the materials of construction can be any combination of steel, plastic, or other material which will accomplish the same results. The specific dimensions of the shell catcher parts, likewise, are not critical, nor is the spacing and relationship of the various parts to each other, and in fact these dimensions would have to be modified to permit installation on semi-automatic guns of different models and manufacture. The means of attaching the shell catcher to the receiver of the gun, likewise, is not important, and can be accomplished by press-in (snap-in) pins 18 that fit into the trigger plate pin holes in the receiver of the gun, as described, or by drilling new holes in the receiver, or by means of brackets, clamps, glue, cement, or even magnetic devices, to name but a few methods.

It also may be desirable to coat the shell catcher 12 with a suitable material to provide an attractive appearance, an appearance which matches the receiver or corrosion resistance, or to prevent possible marring or scratching of the gun receiver. Suitable coating or plating may be applied to the shell catcher 12 using gun blue, gun black materials, Teflon, Martin Hard Coat, or anodization.

Although the shell catcher 12 contains a spring-wire hoop and loop arrangement 56, 46 to catch and hold the expended shell 68, in actual operation the shell 68 can be caught and held by the hoop alone, by the loop alone, or by both the hoop and loop working together. Moreover, the hoop and/or the loop may be made from materials other than spring-wire, and in various different shapes in variance from that contained in the working model.

Obviously many modifications and variations of the present invention are possible in light of the above teachings. It is, therefore, to be understood that within the scope of the appended claims the invention may be practiced otherwise than as specifically described.

What is claimed is:

1. In combination, a firearm having a receiver with an opening in one side thereof for ejection of a spent shell therefrom, a shell ejection mechanism, and an extended reciprocable bolt in said receiver operable with said shell ejection mechanism to eject spent shell through said opening in said receiver, and a shell catcher having a fixed means attached to said receiver and a movable means spaced therefrom, means for pivotally mounting said movable means to said fixed means, a latching mechanism for latching said movable means in a predetermined position with respect to said fixed means and out of position of said opening in said receiver, said latching means having a triggering edge formed thereon and releasable when operated by said extended reciprocable bolt of said firearm, biasing means coupled between said fixed means and said movable means for biasing said movable means into an unlatched position, and hoop and loop means secured to said movable means and arranged to be clear of said opening in said receiver when said movable means is in a latched position with respect to said fixed means, with said hoop and loop means being positioned to cover said opening of said receiver to receive and secure a spent shell ejected through said opening when said movable means is in an unlatched position, whereby the extent and timing of the pivotal action of said movable means is limited and controlled by the latching mechanism and biasing means in conjunction with the normal firing and subsequent operation of the action of the extended reciprocable bolt engaging the triggering edge of said latching mechanism to release it from a latched to an unlatched position.

2. In the combination as recited in claim 1, and means for detachably attaching said fixed means to said receiver of said firearm.

3. In the combination as recited in claim 1, wherein said fixed means and said movable means consist of two flat plate members arranged substantially parallel with respect to each other.

4. In the combination as recited in claim 1, wherein said movable means is pivotably mounted to said fixed means near the center thereof.

5. In the combination as recited in claim 1, wherein said hoop and loop means consist of a spring-wire having an open hoop formed therein, with a loop on each end of said open hoop.

6. A shell catcher for use with an semi-automatic firearm having an opening in a receiver therein for ejection of a spent shell, comprising, a fixed means and a movable means spaced therefrom, means for detachably securing said fixed means to the receiver of said firearm, means for pivotally mounting said movable means to said fixed means, a latching mechanism for latching said movable means in a position with respect to said fixed means and said opening in said receiver, said latching means having a triggering edge formed thereon and releasable when operated by said firearm, biasing means coupled between said fixed means and said movable means for biasing said movable means into an unlatched position, and hoop and loop means secured to said movable means and arranged to be clear of said opening in said receiver when said movable means is in a latched position, and when said movable means is in an unlatched position, said hoop and loop means is positioned to cover said opening of said receiver to receive and secure a spent shell ejected through said opening of said receiver.

7. In the combination as recited in claim 6, and means for detachably attaching said fixed means to said receiver of said firearm.

8. In the combination as recited in claim 7, wherein said fixed means and said movable means consist of two flat plate members arranged substantially parallel with respect to each other.

9. In the combination as recited in claim 8, wherein said movable means is pivotably mounted to said fixed means near the center thereof.

10. In the combination as recited in claim 9, wherein said hoop and loop means consist of a spring-wire having an open hoop formed therein, with a loop on each end of said open hoop.

* * * * *